United States Patent [19]

Dick

[11] Patent Number: 4,790,161

[45] Date of Patent: Dec. 13, 1988

[54] KEYRING ACCESSORY

[76] Inventor: Edward M. Dick, 711 River Rd., Des Plaines, Ill. 60016

[21] Appl. No.: 74,266

[22] Filed: Jul. 16, 1987

[51] Int. Cl.[4] ..... B25B 33/00

[52] U.S. Cl. ..... 70/456 R; 70/458

[58] Field of Search ..... 70/456 R–458 R; 24/3 K, 3 R

[56] References Cited

U.S. PATENT DOCUMENTS

| | | | |
|---|---|---|---|
| 765,754 | 7/1904 | Siersdorfer | 70/456 R |
| 4,325,273 | 4/1982 | Gibbons | 70/458 X |
| 4,543,860 | 10/1985 | Van Meter | 70/456 R X |
| 4,719,778 | 1/1988 | Murphy et al. | 70/458 X |

*Primary Examiner*—Robert L. Wolfe

*Assistant Examiner*—Suzanne L. Dino

*Attorney, Agent, or Firm*—Trexler, Bushnell, Giangiorgi & Blackstone, Ltd.

[57] ABSTRACT

A keyring accessory comprises a one-piece plastic structure having a body, one end of which has a loop for attachment to a keyring, the other end having a wedge for spreading apart the elements of the keyring to permit a key to be inserted between the ring elements of the key ring or to permit removal of the key from those wire ring elements. A flexible strap joins the loop and the wedge. The wedge is sufficiently rigid to permit separation of the wire circles forming the keyring, and the size and the way the wedge is shaped prevents the wedge from accidentally popping out from between the circular rings.

4 Claims, 1 Drawing Sheet

KEYRING ACCESSORY

BACKGROUND OF THE INVENTION

This invention relates to improvements in keyholders.

The type of keyholder with which the present invention is concerned is of a conventional construction and comprises a single length of spring wire of steel or the like which may be of a somewhat concave-convex cross section. The wire is shaped on known machinery to form a pair of substantially congruent circles which are abutting throughout and are coaxial. The circles are joined by a crossover section of the spring material, this crossover section being offset from each circle. The crossover section defines in cooperation with the opposite ends of the wire, a pair of access openings at which a key may be mounted or removed from the keyring. This is accomplished by first spreading one of the opposite ends from the region of the crossover to provide a sufficiently large opening for installing or removing the key from the ring.

It is known that in a keyring of the foregoing type attempting to spread one of the opposite ends from the crossover, a fingernail is frequently broken or other difficulties are encountered. Sometimes the spring of the wire is so stiff that the wire must be distended by the use of a tool of some kind or another. However, such tools are not usually available the very time they are needed.

OBJECTS AND SUMMARY OF THE INVENTION

It is an object of the present invention to provide a keyring of the foregoing type that comprises an accessory formed of a one-piece, plastic, flexible body which may be attached to the keyring and which has a wedge which is sized and shaped to be inserted between the two circles of the keyring and will spread them apart quickly and simply for installation or removal of a key from the keyring.

A further object of this invention is to provide a keyring of the type stated in which the improved accessory is extremely light in weight, is relatively easy to use, and does not interfere with the normal use of the keyring.

Broadly speaking, the keyring accessory comprises the unitary plastic structure having a body configured and sufficiently thin and flexible to define at one end thereof, a pliable attaching means for securing the accessory to the key ring. At the other end of the body is a wedge for spreading apart the wire circles of the keyring. Joining the two ends is a pliable strip of sufficient length to enable the wedge to be inserted easily at various places along the circumference of the congruent wire circles. The wedge is of a relatively rigid construction, as compared to the pliable strip, and projects outwardly from a localized enlargement or bead at the end of the strip.

The attainment of other objects and advantages of the invention will be apparent from the following detailed description taken in conjunction with the drawing forming a part thereof.

DETAILED DESCRIPTION

Figure 6:
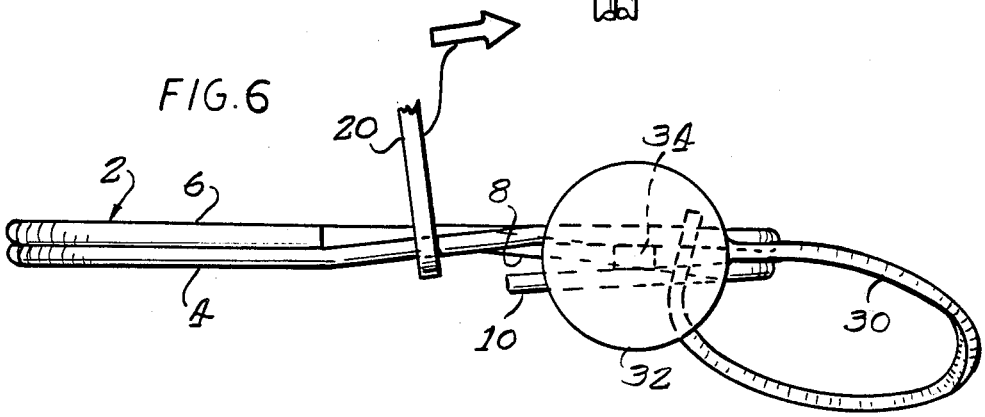
FIG. 6 is a fragmentary top plan view of the structure of FIG. 5.

Refering now in more detail to the drawing, which illustrates a preferred embodiment of the present invention, 2 designates a keyring body formed of a length of spring wire or other spring material which may have an approximately concave-convex cross section. The body 2 is shaped to form substantially congruent circular rings 4, 6 which are abutting and coaxial. There is a crossover section 8 which joins the congruent rings 4, 6. The crossover section 8 is offset from each circle 4, 6 to cooperate with opposite ends 10, 12 of the wire piece to define a pair of access openings 14, 16. One or more of the keys 20, that are mounted on the keyring are removed from the keyring by first spreading one of the opposite ends 10, 12 as may be conventionally determined by the position of the key on the ring. For example, a key may be removed by passing the key through the opening 14 defined by the end 10 and crossover 8, as best shown in FIG. 6.

Provided for mounting on the keyring body 2 is a one-piece molded plastic accessory 21 having a body 22 which includes, generally speaking, a means 24 for attaching the accessory 21 to the keyring body 2 and a means 26 which is adapted for use in removing a key 20 from the keyring or mounting a key thereon. The plastic body 2 is preferably formed of a polyamide resin of the type known as "nylon," although it is within a scope of the invention to use other plastic materials which may be found to be suitable.

Figure 1:
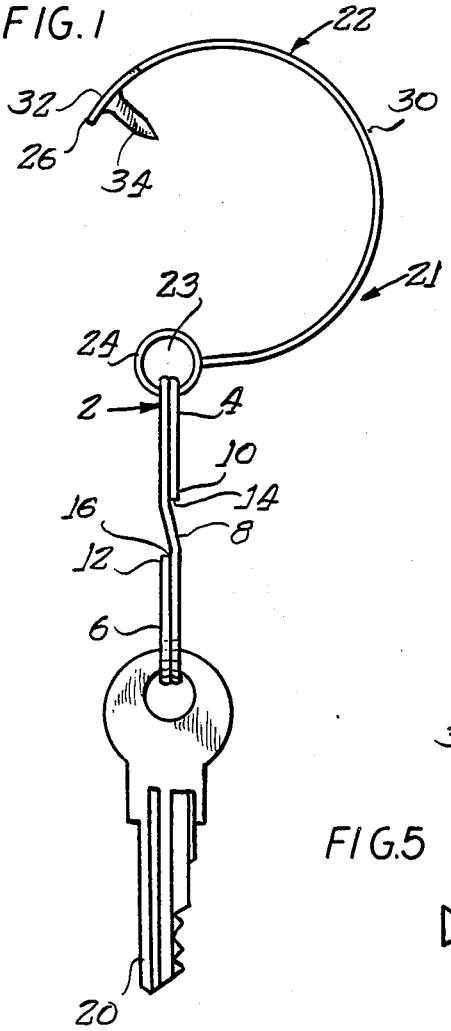
FIG. 1 is a side-elevational view of a keyring and accessory constructed in accordance with and embodying the present invention.
Figure 2:
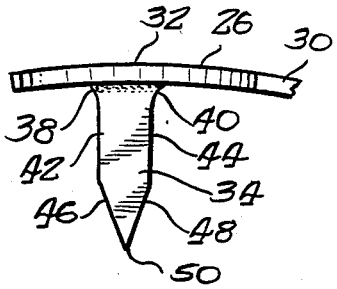
FIG. 2 is a fragmentary view on an enlarged scale of a portion of FIG. 1 in the region of the wedge which forms part of the present invention.
Figure 4:
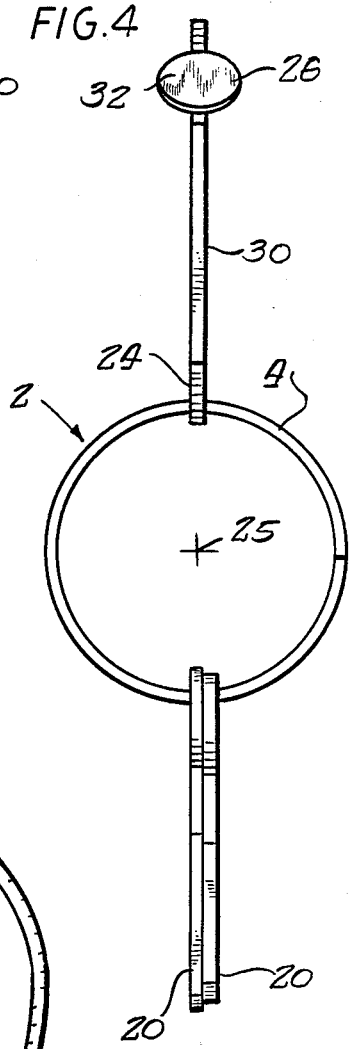
FIG. 4 is a side-elevational view of the structure of FIG. 1.
Figure 3:
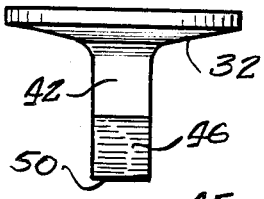
FIG. 3 is a fragmentary side-elevational view of the structure of FIG. 2.
Figure 5:
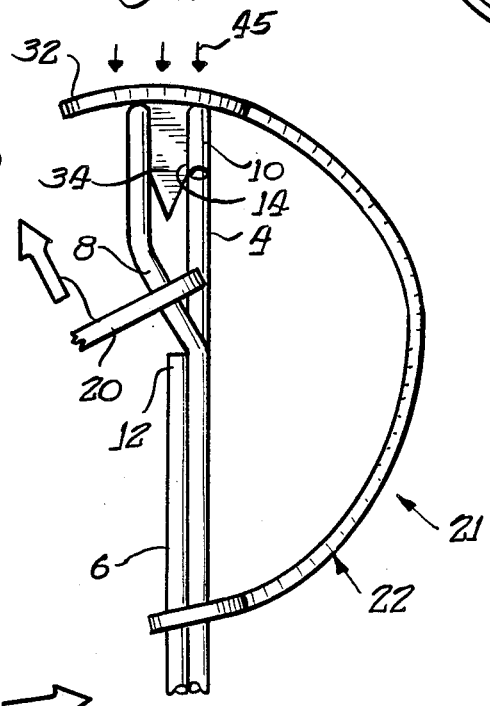
FIG. 5 is a side-elevational view showing the manner in which the wedge is utilized to spread apart the congruent wire circles of the keyring.

The attaching means 24 is preferably in the form of a cylindrical loop having a central opening 23 which, as shown in FIG. 1, is much larger in diameter than is the maximum dimension of the keyring measured across the combined thicknesses of the two rings, i.e. the tube ring diameters 2. This provides a very loose connection between the keyring and the attaching means 24.

Joining the attaching means 24 is an arcuate highly resilient and flexible strap 30, which is generally in the form of an arc, when not in use. On the end of strap 30 which is opposite to the attaching means 24 is a localized enlargement or bead 32 that is relatively thick as compared to the thickness of the strap 30. This forms a rigidifying end member.

Projecting radially inwardly from the bead or enlargement 32 is a wedge 34, the bead 32 in effect constituting a base for the wedge 34. The wedge 34 comprises diverging arcuate wall portions 38, 40 which join the wedge to the bead 32, it being understood, however, that portions 38, 40 may be straight or include straight sections that diverge from the tip 50 of the wedge 34. Wedge 34 also includes spaced parallel side portions 42, 44 which merge into wall surfaces 46, 48 that converge toward and terminate in the tip 50 of the wedge. It should be understood, however, that parallel wall portion 42, 44 may be slightly undercut, that is to say they may slightly diverge toward the tip 50.

In use, assuming it is desired to mount a key 20 onto the key ring. The wedge 34 is inserted between the congruent circles 4, 6 by applying pressure to the bead 32 in the direction of the arrows 45. This spreads apart the adjacent wire portions whereupon the key 20 is passed between one of the sections 8 or 10 and onto the keyring. Thereafter the wedge is removed from between the wire circles 4, 5 and the key may be manipulated to the crossover section at 8, this being able to be accomplished after removal of the wedge 34 from between circular rings 4, 6.

In connection with the foregoing procedure, it should be noted that the nylon wedge 34 has a certain degree of anti-friction properties, which results in the wedge 46 being readily insertable between the wire circles 4, 6 and radially inwardly of the wire circles 4, 6. Moreover, when the wedge 34 is manipulated manually by being shifted between the wires 4, 6 and away from the crossover 8, two rings will lodge and seat against the wall portion 42, 44 and this will provide a relatively low friction bearing surface that facilitates easy movement of the wedge 44. If the surfaces 42, 44 are parallel or slightly undercut, there will be a tendency to retain the wedge within the confines of the rings 4, 6 and this helps preclude the wedge from accidentally popping out of the position between the rings 4, 6.

Furthermore, it should be noted that the strap 30 is made sufficiently long and sufficiently flexible so U that it enables the wedge 34 to be inserted between the wire circles 4, 6 anywhere along the circumference of the keyring.

The invention is claimed as follows:

1. In a keyring of the type having a body of a length of spring material with opposite ends and shaped to form two substantially congruent circles which are abutting and coaxial, and with there being a crossover section of the spring material that joins the two circles and is offset from each circle and defines in cooperation with said opposite ends a pair of adjacent access openings at which a key may be mounted on or removed from the keyring by first spreading one of said opposite ends from the region of the crossover to provide a sufficiently large opening for installing or removal from the ring, an improvement comprising an accessory with a one piece flexible plastic body having means for attaching said accessory to said keyring body, said accessory having a wedge thereon, said wedge being sized and shaped to be manually inserted between the circles to open either of the access openings and thereby permit installation or removal of a key from the ring, said accessory furthermore being resilient and with an arcuate shaped portion between said wedge and said attaching means, said arcuate shaped portion maintaining an arcuate configuration during the insertion and removal of the wedge from between said circles.

2. The construction according to claim 1 in which said localized enlargement is at one end of the accessory body, and the attaching means is a closed loop at the other end of the accessory body, and there is a resilient strap that joins the loop and the enlargement.

3. A keyring accessory for facilitating attachment of and removal of a key from a keyring of a type including two elements that are spread apart to provide an opening through which said key attachment and removal takes place, comprising a unitary plastic structure having a body configured and sufficiently thin to define a pliable attaching means at one end for attachment to a keyring, a localized portion of said body remote from said attaching means having an enlargement that is relatively wide and rigid as compared to the width and rigidity of the parts of said body that are adjacent to said enlargement, said enlargement having a surface constituting a base, a wedge projecting outwardly from said base, and a thin, resilient strip joining said attaching means to said enlargement, said strip being of arcuate configuration so as normally to project as a curved form away from said attaching means.

4. A keyring accessory comprising a unitary plastic structure having a body with opposite ends, one end having a loop for attachment to a keyring and the other end having a wedge for spreading apart elements of a key ring and between which elements a key passes when mounting on or removal of a key from the ring, and a resilient strap between the wedge and the loop, said strap being an arcuate structure, an enlargement attached to said strap and said enlargement being at the base of said wedge and constituting a structure at which pressure may be applied to the wedge to drive said wedge between elements of a keyring.

* * * * *